US009421669B2

(12) United States Patent
Ong

(10) Patent No.: US 9,421,669 B2
(45) Date of Patent: Aug. 23, 2016

(54) SINGLE GROOVED POLISHING PAD

(71) Applicant: GLOBALFOUNDRIES Singapore Pte. Ltd., Singapore (SG)

(72) Inventor: Wee Yang Ong, Singapore (SG)

(73) Assignee: GLOBALFOUNDRIES Singapore Pte. Ltd., Singapore (SG)

( * ) Notice: Subject to any disclaimer, the term of this patent is extended or adjusted under 35 U.S.C. 154(b) by 181 days.

(21) Appl. No.: 13/950,298

(22) Filed: Jul. 25, 2013

(65) Prior Publication Data

US 2014/0030958 A1 Jan. 30, 2014

Related U.S. Application Data

(60) Provisional application No. 61/677,457, filed on Jul. 30, 2012.

(51) Int. Cl.
*B24B 53/017* (2012.01)
*B24B 37/26* (2012.01)

(52) U.S. Cl.
CPC ..... *B24B 53/017* (2013.01); *B24B 37/26* (2013.01)

(58) Field of Classification Search
CPC ..... B24B 37/26; B24B 53/017
USPC ..... 451/56, 41, 443, 444
See application file for complete search history.

(56) References Cited

U.S. PATENT DOCUMENTS 6,139,428 A * 10/2000 Drill et al. ..... 451/41
6,190,236 B1 * 2/2001 Drill ..... 451/41
6,241,587 B1 * 6/2001 Drill et al. ..... 451/56
6,699,115 B2 * 3/2004 Osterheld et al. ..... 451/527
8,021,566 B2 * 9/2011 Chuang et al. ..... 216/83
2003/0236055 A1 * 12/2003 Swedek et al. ..... 451/8
2006/0019587 A1 * 1/2006 Deopura et al. ..... 451/526
2007/0238393 A1 * 10/2007 Shin et al. ..... 451/5
2008/0182493 A1 * 7/2008 Muldowney ..... 451/527
2009/0191794 A1 * 7/2009 Wang ..... 451/41
2009/0258575 A1 * 10/2009 Hreha et al. ..... 451/37
2010/0009601 A1 * 1/2010 Wang ..... 451/36
2010/0056031 A1 * 3/2010 Chiu et al. ..... 451/527
2010/0216378 A1 * 8/2010 Choi et al. ..... 451/287
2011/0136411 A1 * 6/2011 Nakanishi et al. ..... 451/41
2011/0244763 A1 * 10/2011 Yuan et al. ..... 451/56
2012/0073210 A1 * 3/2012 Lefevre et al. ..... 51/295
2012/0244785 A1 * 9/2012 Wang et al. ..... 451/28
2014/0024299 A1 * 1/2014 Tu et al. ..... 451/282

FOREIGN PATENT DOCUMENTS

WO WO 2006003697 A1 * 1/2006 ..... B24B 37/26
WO WO 2006070629 A1 * 7/2006 ..... B24B 37/04

OTHER PUBLICATIONS

WO 2006003697 A1—Jan. 2006—English Translation created using "Google Translate".*

* cited by examiner

*Primary Examiner* — Joseph J Hail
*Assistant Examiner* — Marc Carlson
(74) *Attorney, Agent, or Firm* — Horizon IP Pte. Ltd.

(57) ABSTRACT

A polishing pad, an apparatus for chemical mechanical polishing of semiconductor wafers and a method of making a device using the same are presented. The apparatus includes a first platform for mounting a semiconductor wafer; a second platform for mounting a polishing pad; a rotator for rotating the wafer against the polishing pad; and a diamond dresser for dressing the polishing pad. The polishing pad has a single groove of a width (w) surrounding the periphery of an undressed portion of the polishing pad thus eliminating contact of the undressed portion with the outer edge of the diamond dresser.

18 Claims, 11 Drawing Sheets

SINGLE GROOVED POLISHING PAD

BACKGROUND

Chemical mechanical polishing (CMP) is used in semiconductor manufacturing processes for planarizing a wafer or other work piece. To maintain the stability and throughput of CMP, the polishing pads used in CMP should be dressed by a diamond dresser.

The function of the diamond dresser is to maintain or restore the polishing characteristics of the polishing pad to the maximum extent possible during the polishing process and in doing so, extend the useful life of the polishing pad. The dressing step may be performed simultaneously with the polishing of the wafer, or as a separate step after every wafer or an x number of wafers is polished. The diamond dresser performs this function by exerting pressure on the polishing pad thereby affecting the polishing characteristics of the polishing pad.

Diamond dressers are generally made with diamonds. The usage of diamonds and the designs of most diamond dressers are such that the last 2 mm to 3 mm towards the outer circumference of the dressers are not covered by diamonds. Therefore, when the polishing pad is dressed down, the travel of this 2 mm to 3 mm of flat outer circumference region would be obstructed by the undressed part of the pad material. Such undressed part of the polishing pad affect CMP removal rate stability and increases wafer range issues as the polishing pad ages, thus limiting any future pad consumable life extension.

From the foregoing, it is desirable to provide an improved polishing pad that addresses the issue caused by the undressed part of the pad material.

SUMMARY

Embodiments generally relate to a polishing pad, an apparatus for chemical mechanical polishing of semiconductor wafers and a method of making a device using the same. The apparatus includes a first platform for mounting a semiconductor wafer; a second platform polishing for mounting a polishing pad; a rotator for rotating the wafer against the polishing pad; and a diamond dresser for dressing the polishing pad. The polishing pad has a single groove of a width (w) surrounding the periphery of an undressed portion of the polishing pad thus eliminating contact of the undressed portion with the outer edge of the diamond dresser.

In another embodiment, a method of making a device comprises providing a wafer with a first surface; polishing the first surface of the wafer with a polishing pad, wherein the polishing pad comprises a dressed portion, an undressed portion and a groove separating the dressed and undressed portions; and dressing the polishing pad with a diamond dresser. The groove separating the dressed and undressed portion of the polishing pad eliminates contact of the undressed portion with the outer edge of the diamond dresser.

In yet another embodiment, a pad for polishing a wafer is disclosed. The pad includes a dressed portion, an undressed portion and a groove separating the dressed and undressed portions. The groove includes a width (w) surrounding the periphery of the undressed portion. The groove eliminates contact of the undressed portion with an outer edge of a diamond dresser when the pad is mounted to an apparatus for chemical mechanical polishing the wafer.

These advantages and features of the embodiments herein disclosed will become apparent through reference to the following description and the accompanying drawings. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Embodiments generally relate to a polishing pad for used in CMP. The polishing pad is dressed by a diamond dresser while planarizing a wafer. In one embodiment, the diamond dresser may be a Shinhan dresser made with blocky type diamonds. In other embodiments, the diamond dresser may be manufactured by other manufacturers and may be made with other types of diamonds, for example, irregular shaped diamonds.

Figure 1:
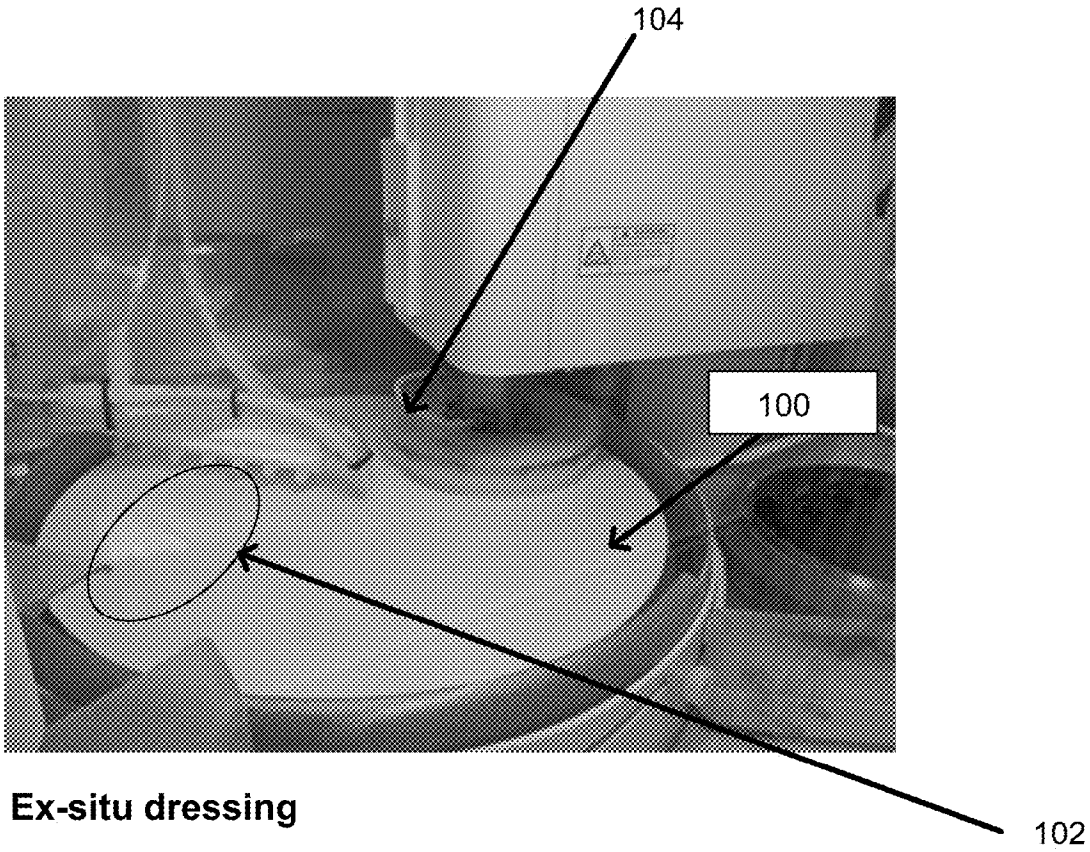
FIG. 1 shows the ex-situ dressing of a polishing pad.
Figure 2B:
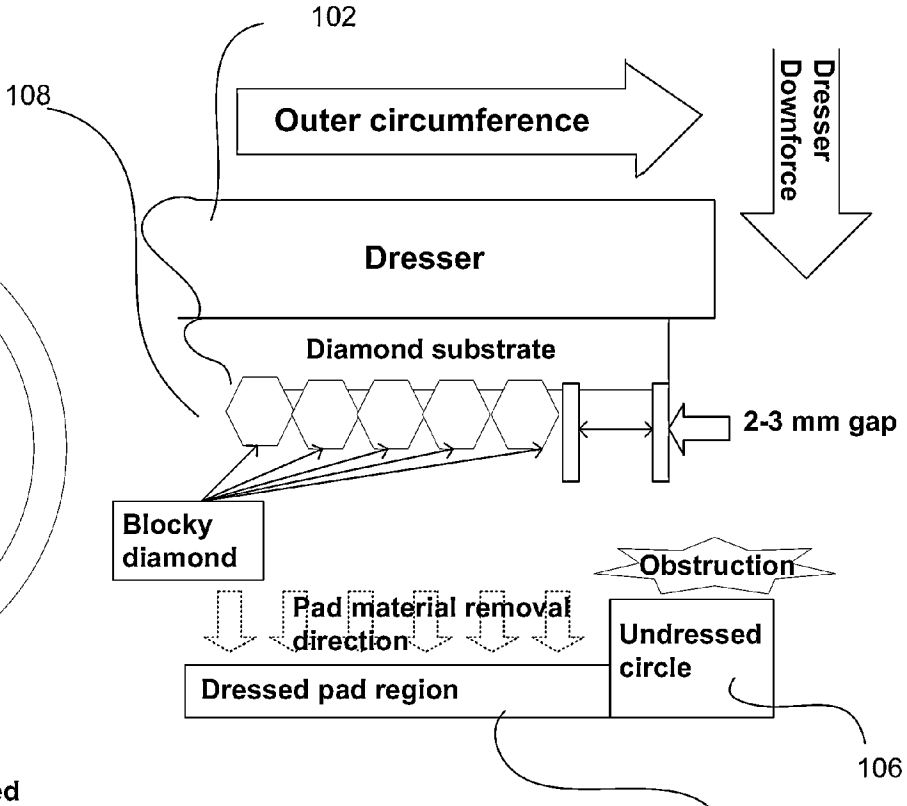
FIGS. 2*a-b* show top and side views of the ex-situ dressing in FIG. 1.
Figure 2A:
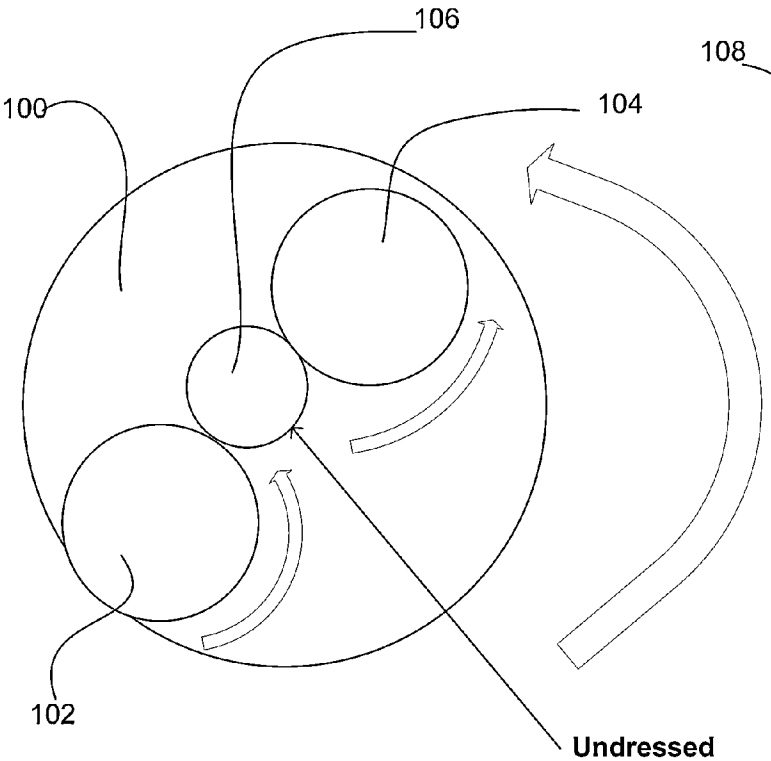

FIG. 1 shows the ex-situ dressing of a polishing pad. As shown, the polishing pad 100 is being dressed by a diamond dresser 102 while a wafer (not shown) in the top ring 104 is being planarized by the polishing pad. Referring to FIGS. 2*a* and 2*b*, which show top and side views of the ex-situ dressing in FIG. 1, respectively; an undressed portion 106 can be seen in both the top and side views. While the diagrams show an undressed circle, such undressed portion 106 may also be of another shape or be of irregular shape.

Referring to FIG. 2*b*, it can be seen that the gap of about, for example, 2-3 mm in the blocky diamond 108 of the diamond dresser 102 results in physical contact with an undressed portion 106, which would result in obstruction of the dressing action. As the pad is progressively dressed, the obstruction of the dressing action by the undressed portion becomes more severe, limiting downward travel of the diamond dresser, altering the polishing pad cross section profile and the polishing pad cut rate. This could cause increase polishing time, thus increasing slurry usage, thereby causing wastage.

Figure 3A:
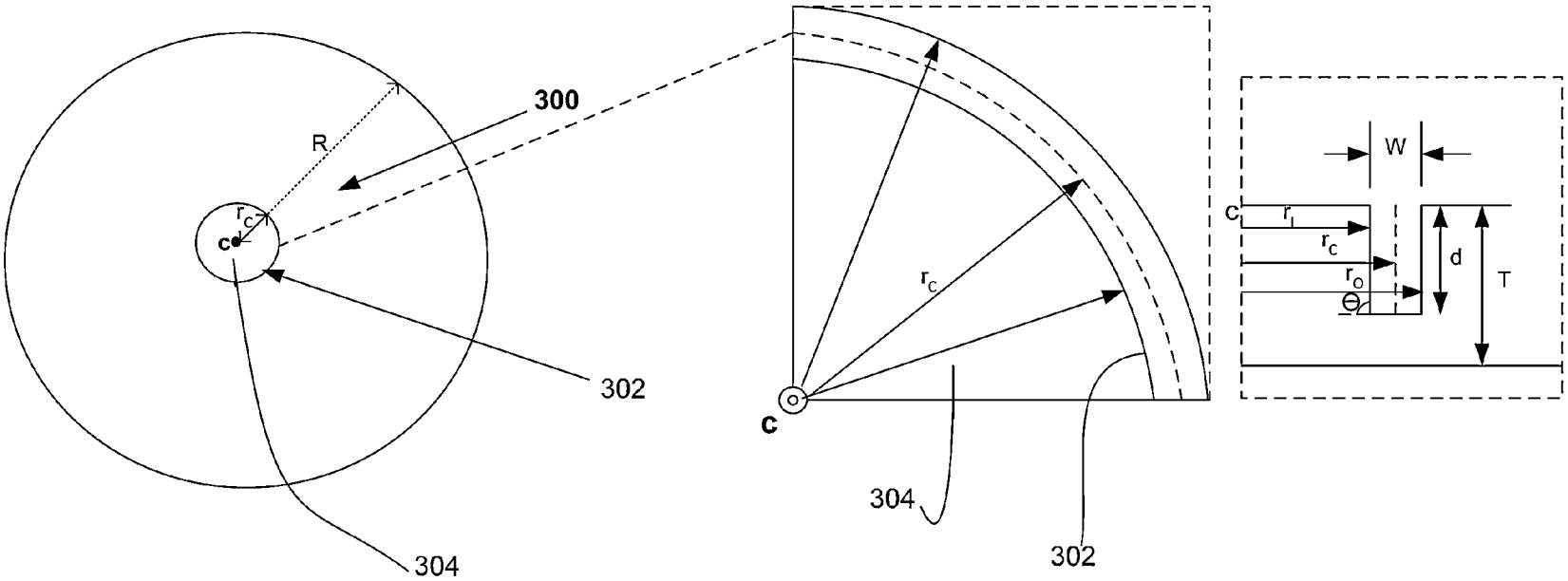
FIGS. 3(*a*)-(*c*) show various embodiments of a polishing pad with a groove including an embodiment with a cutout portion on the polishing pad.
Figure 3B:
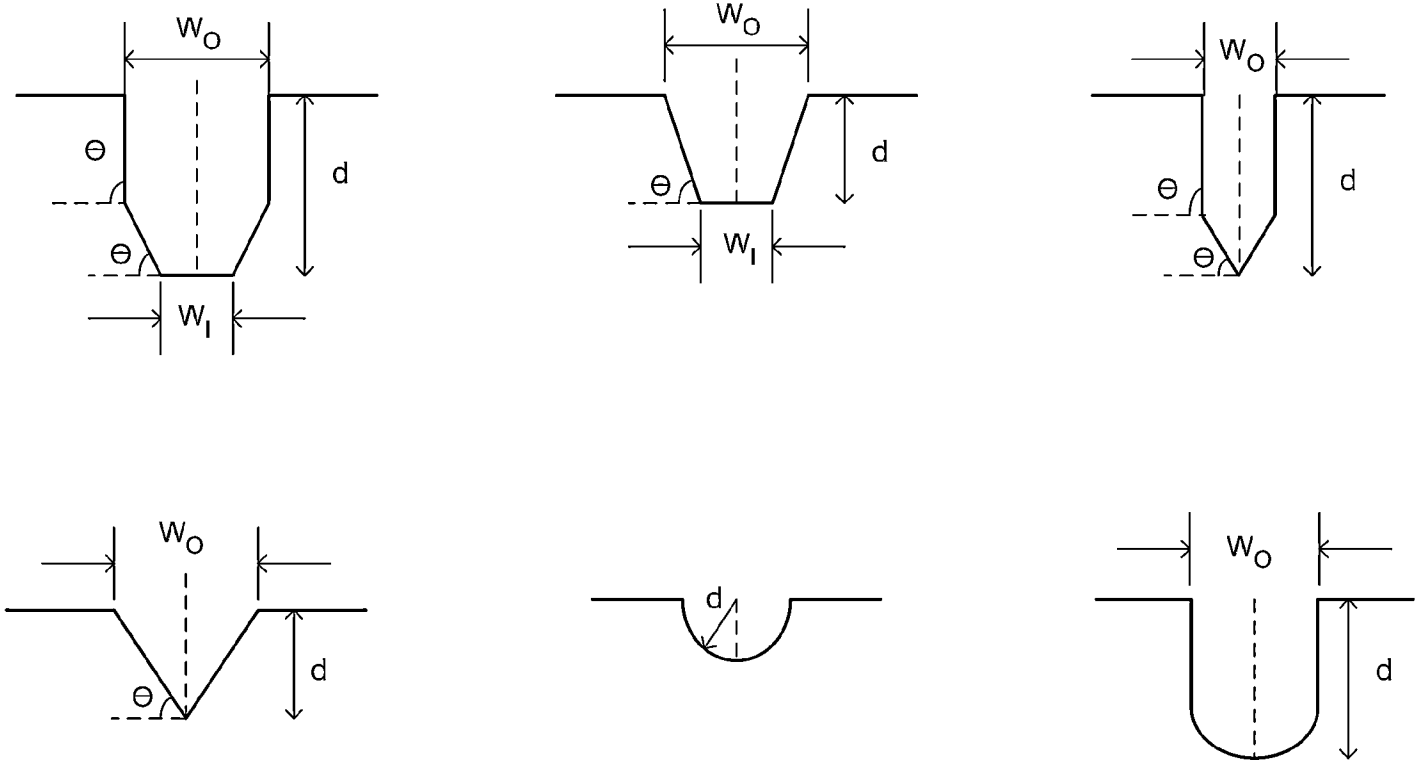
Figure 3C:
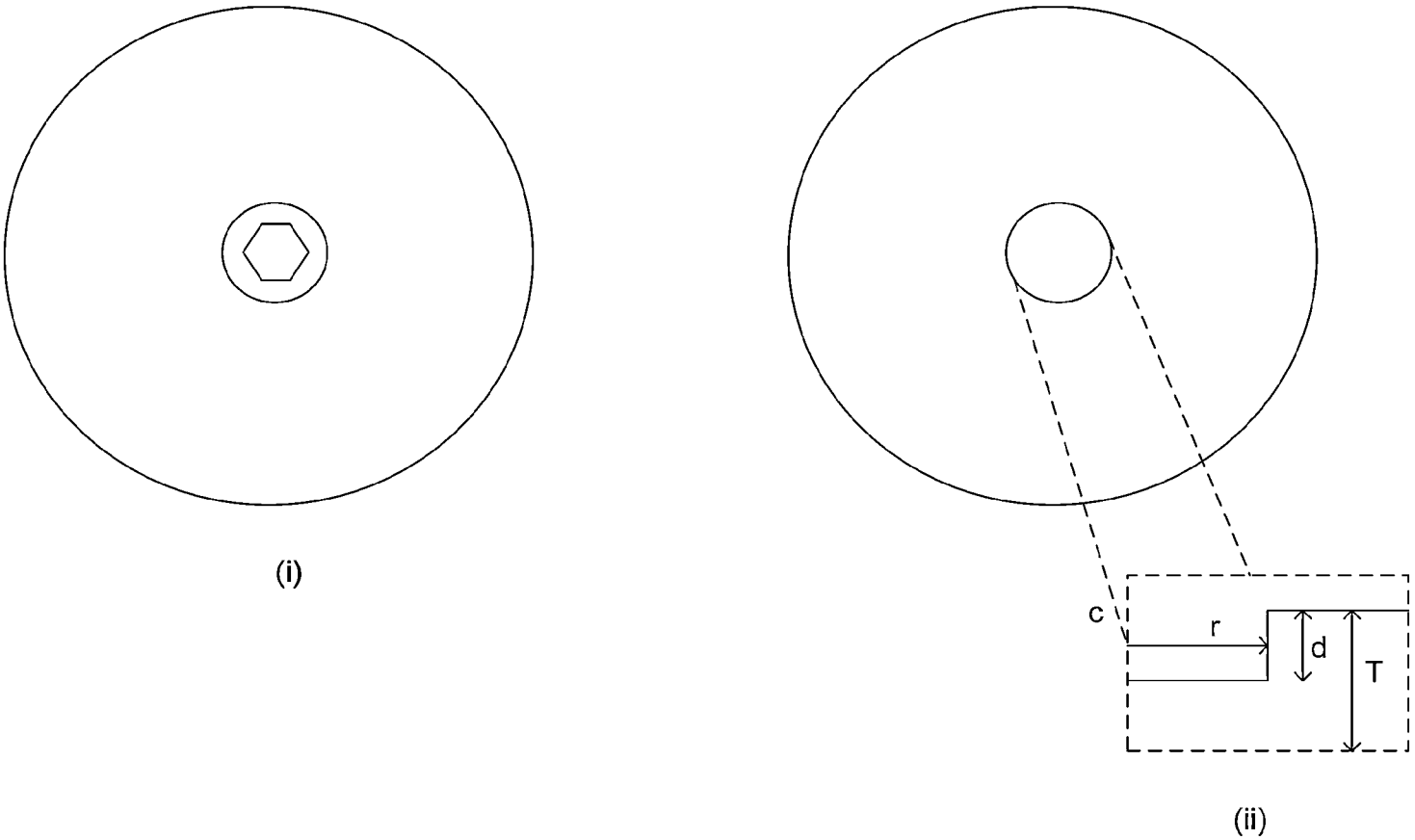

FIGS. 3(*a*)-(*c*) show various embodiments of a polishing pad with a groove including an embodiment with a cutout portion on the polishing pad. Referring to FIG. 3(*a*), an embodiment of a polishing pad 300 with cross-sectional view and an enlarged diagram of a groove 302 on the polishing pad 300 is being shown. As can be seen, groove 302 is a single groove surrounding the periphery of an undressed portion 304. As groove 302 is at the polishing pad region where the dresser edge makes contact with the undressed portion 304, groove 302 helps to eliminate contact of the dressed portions of polishing pad 300 with undressed portion 304 of polishing pad 300. Given that the undressed portion 304 is shown as a circle, the groove is therefore also circular in shape as it surrounds the circumference of the circle.

Referring to the enlarged diagram of groove 302 as shown to the left of FIG. 3(*a*), given that undressed portion 304 is shown as a circle, it can be seen that groove 302 may have, for example, an inner radius $r_I$, which is the length extending from the center of polishing pad 300 to the inner circumference of groove 302. Groove 302 may further have, for example, an outer radius $r_O$, which is the length extending from the center of polishing pad 300 to the outer circumference of groove 302. In one embodiment, $r_I$ may be about 48 mm and $r_O$ may be about 56 mm, in which case, groove 302 may have a center radius $r_C$ (which is a radius from the center of polishing pad 300 that is in equidistance apart from $r_I$ and $r_O$) of about 52 mm. Other values for $r_I$, $r_O$ and $r_C$ may also be helpful. For example, $r_I$ may be about 23 mm to 58 mm, $r_O$ may be about 31 mm to 66 mm and $r_C$ may be about 27 mm to 62 mm.

As shown in FIG. 3(*a*), groove 302 may include a gap or width (w). The width of the groove, for example, may be about 8 mm. In order embodiments, the width could be larger or smaller as long as it is wide enough to ensure the outer part of undressed portion 304 could be removed beforehand thus eliminating contact of undressed portion 304 with the flat outer edge of a dresser. The width (w) may also have a minimum and maximum dimension that is expressed in relation to the region of the dresser that is not covered by diamonds (D) and the groove center radius $r_C$ as follows: $D<=w<=r_C+w/2$.

In addition, the groove may have a depth (d), and an angle (θ) as shown in the right most drawing in FIG. 3(*a*). Angle θ may have a range of $0°<=\theta<=100°$. The depth (d) of the groove, for example, may be about 0.7 mm. It should be understood that in other embodiments, the groove may have a shallower or deeper depth. The groove depth (d) in relation to the thickness (T) of polishing pad 300 may be $0<d/T<=1$. The radius $r_C$ in relation to the radius (R) of polishing pad 300 may be $0<r_C/R<=1$.

FIG. 3(*b*) shows several alternative embodiments of the groove bottom cross sectional design. As can be seen, groove 302, instead of having the rectangular bottom as shown in FIG. 3(*a*), may instead have a polygonal bottom or a circular elliptical bottom as shown in FIG. 3(*b*). In other embodiments, the groove may also have a bottom that is of another shape or of an irregular shape. Where the groove bottom is polygonal, various variations are also possible by varying the value of the width (w), the angle (θ) and the depth (d). As shown, in some of the embodiments, the width (w) may have a wider first part ($w_O$) and a narrower second part ($w_I$); alternatively, the polygonal bottom may comprise more than one angle (θ). Similarly, variations of the circular elliptical bottoms may also be obtained by varying the value of the width (w) and the depth (d).

FIG. 3(*c*) shows two alternative embodiments of polishing pad 300. Referring to FIG. 3(*c*)(*i*), the undressed portion 304 may be, for example, an octagonal shape instead of being circular. While an octagonal shape is shown, it should be understood that the undressed portion 304 may also be of irregular shape. As can be seen, groove 302 surrounding the periphery of undressed portion 304 may still be circular in shape. However, in other embodiments, groove 302 in surrounding the periphery of undressed portion 304 may mimic the shape of undressed portion 304. Referring to FIG. 3(*c*)(*ii*), it can be seen that, instead of a groove 302 surrounding the periphery of undressed portion 304, the groove 302 and the undressed portion 304 may be merged and molded to form a depressed region that is below the surface of the polishing pad by a depth (d) to avoid physical contact with the diamond dresser. Alternatively, the entire undressed portion 304 may be cut out to avoid contact with the diamond dresser.

Figure 4A:
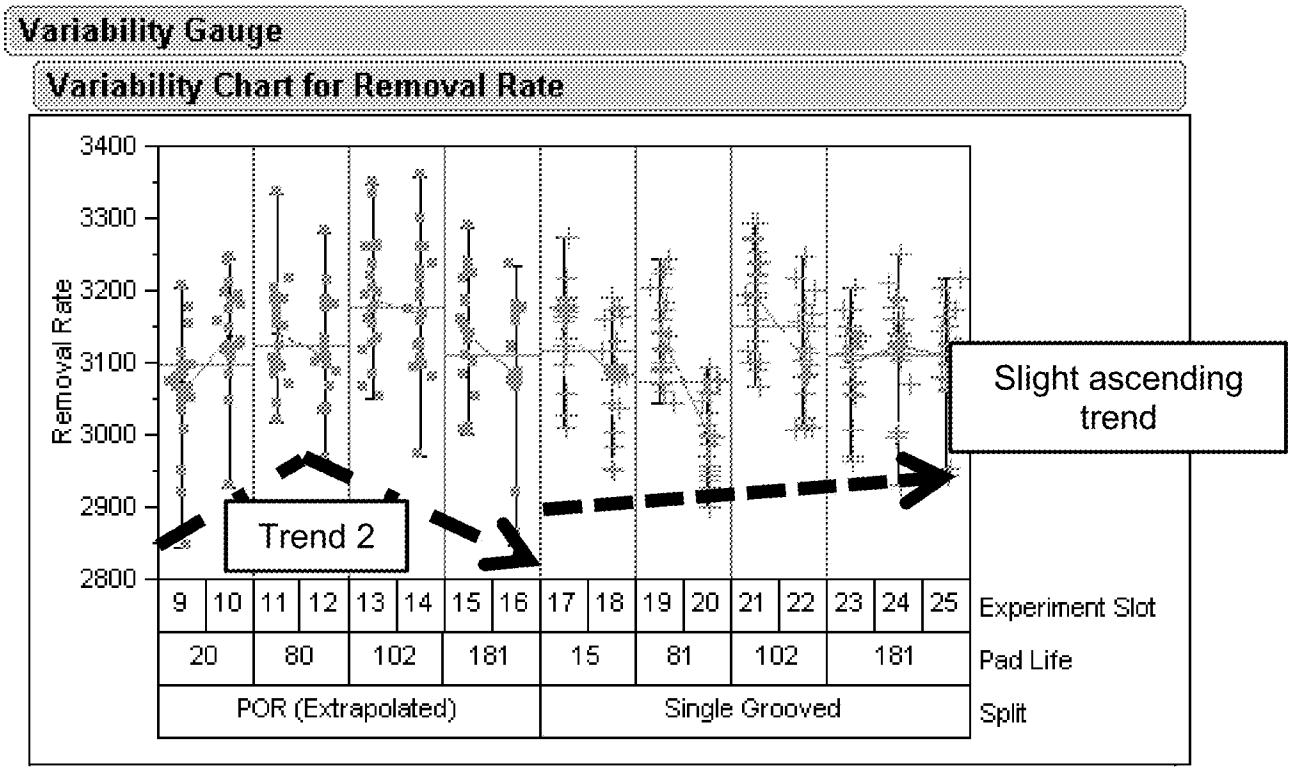
FIGS. 4*a-f* show experimental data comparing, among other factors, the removal rate of a convention polishing pad and an embodiment of a grooved polishing pad.

FIGS. 4*a-f* show experimental data comparing, among other factors, the removal rate of a convention polishing pad and an embodiment of a grooved polishing pad. Referring to FIG. 4*a*, the removal rate of an extrapolated process on record ("POR") polishing pad is compared to a single grooved polishing pad as described above. As can be seen, the removal rate of the single grooved polishing pad remains steady throughout the pad life and even increases slightly as time passes. On the other hand, the extrapolated POR polishing pad removal rate increases for a spell but ultimately decreases as time passes.

Figure 4B:
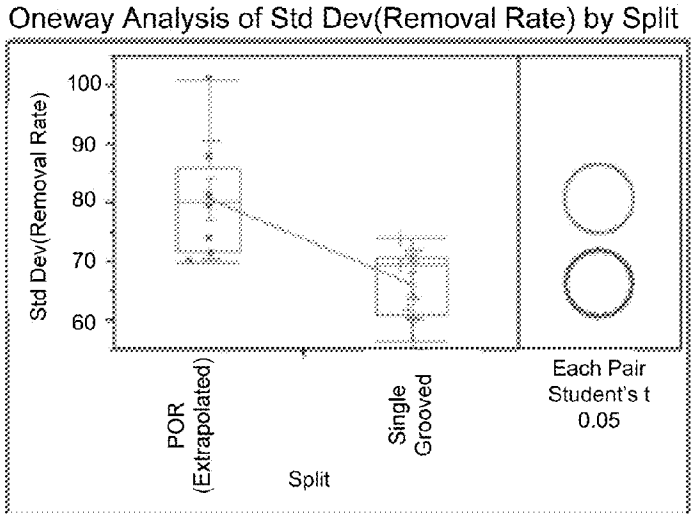
Figure 4B:
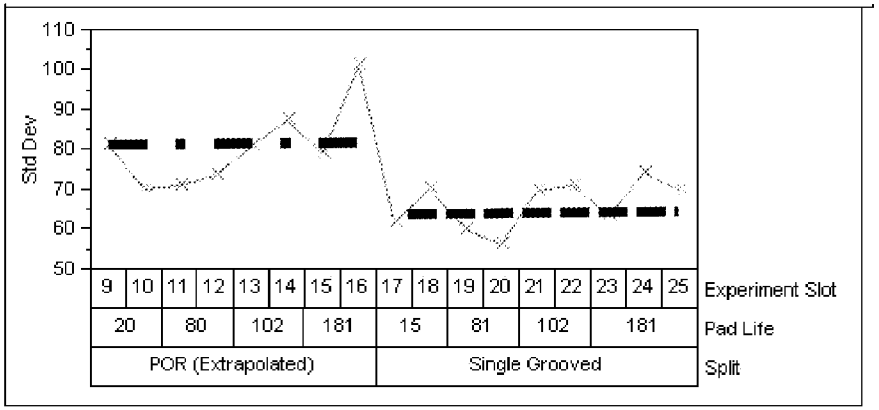

FIG. 4*b* shows the standard deviation of the within wafer non-uniformity for an extrapolated POR polishing pad as compared to a single grooved polishing pad. As shown, the single grooved polishing pad has standard deviation data that fluctuates more closely around the reference line, which indicates that the single grooved polishing pad has a lower within wafer non-uniformity. The boxplot comparison shown to the right, which is a compression of the standard deviation data, also confirms this as the spread of the standard deviation data for the single grooved polishing pad is much tighter as compared to the extrapolated POR polishing pad. Furthermore, the fact that the single grooved polishing pad data does not overlap with the extrapolated POR polishing pad data shows that the difference between the 2 pads is significant.

Figure 4C:
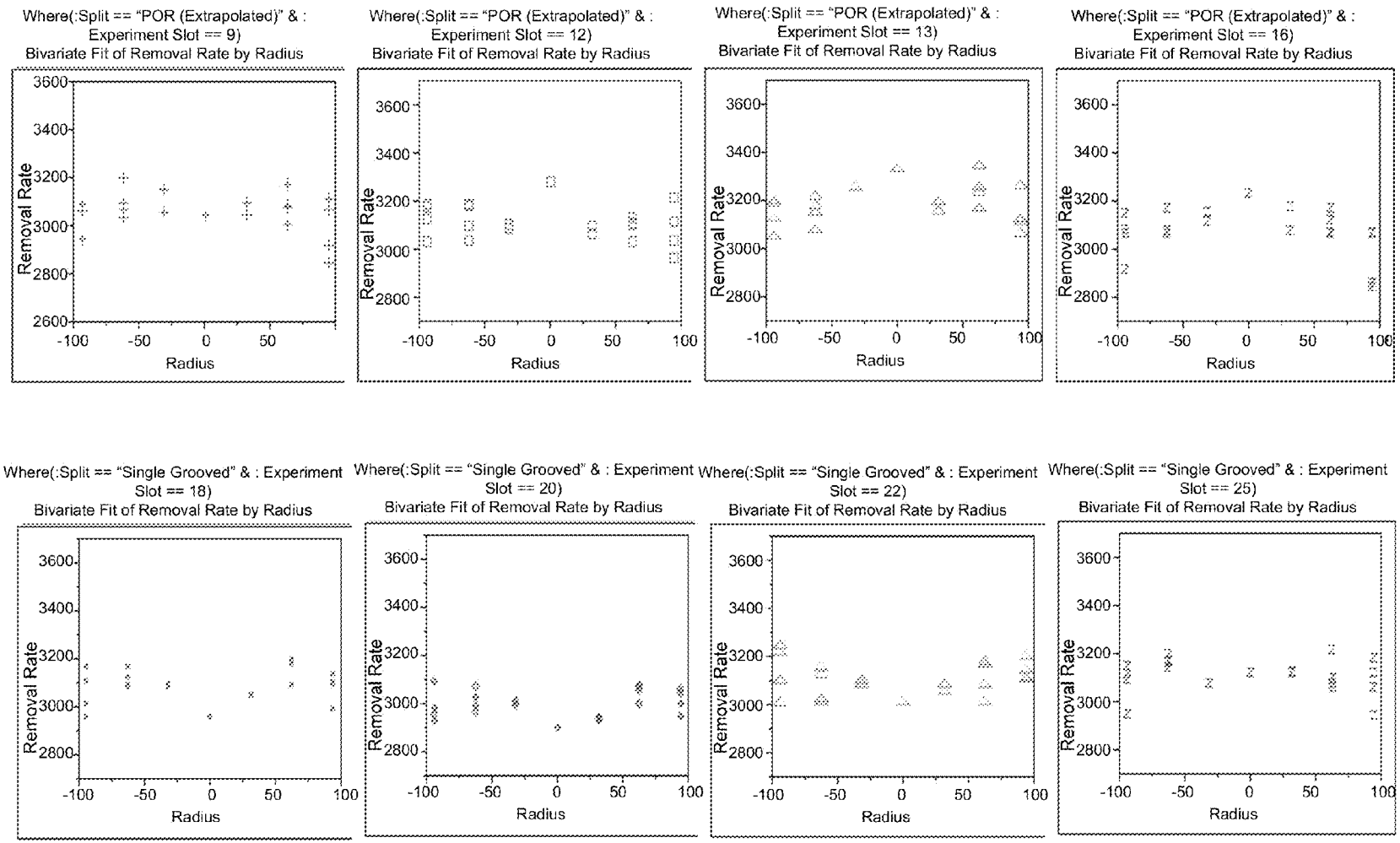
Figure 4D:
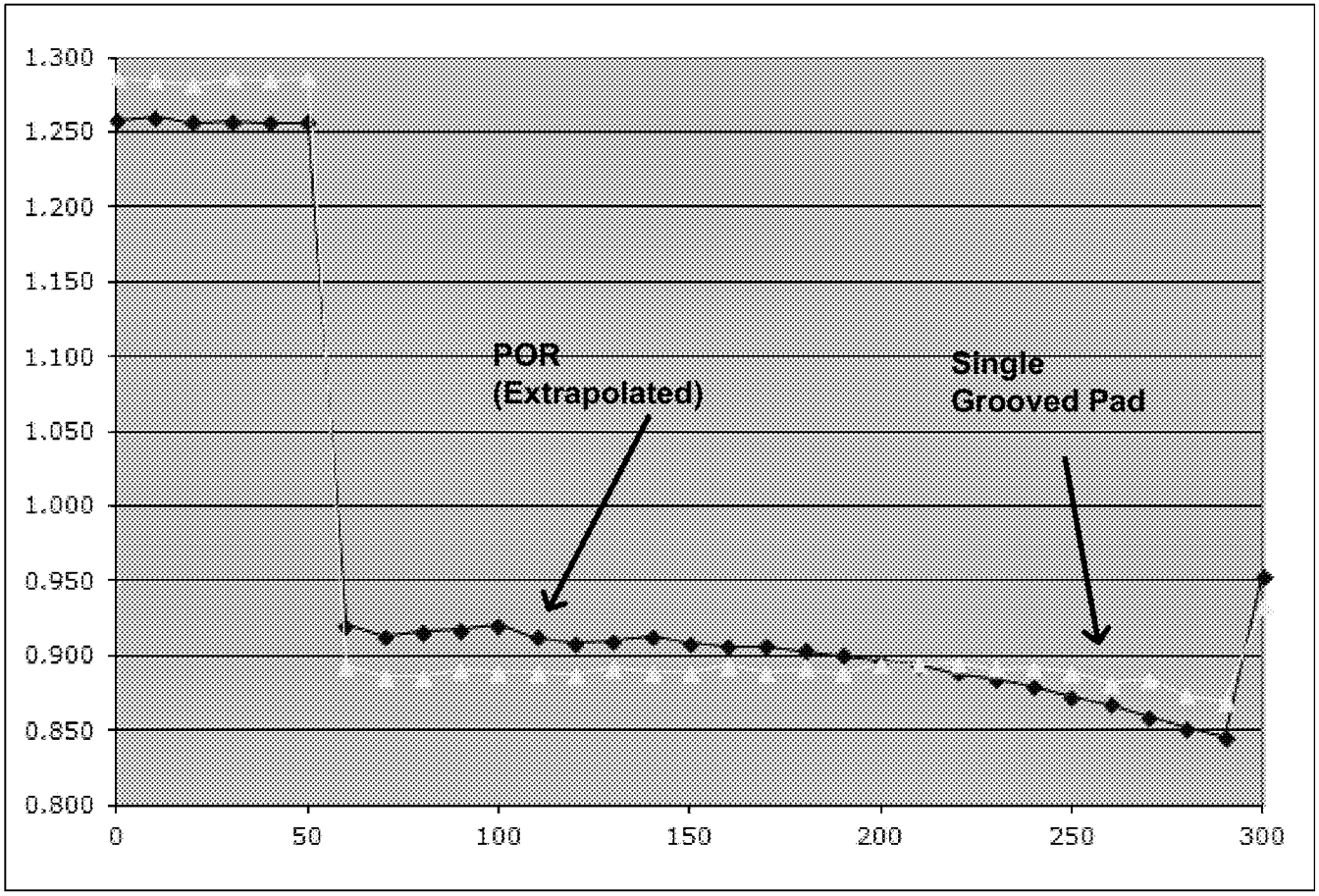

FIG. 4*c* shows the removal rate profile plot for an extrapolated POR polishing pad as compared to a single grooved polishing pad. As can be seen, profile wise, the single grooved polishing pad achieves higher edge removal as time passes as compared to the extrapolated POR polishing pad. FIG. 4*d* shows the pad profile of an extrapolated POR polishing pad as compared to a single grooved polishing pad. As can be seen, the single grooved polishing pad has a pad profile that is flatter, and has a gentler slope as compared with the pad profile of the extrapolated POR polishing pad.

Figure 4E:
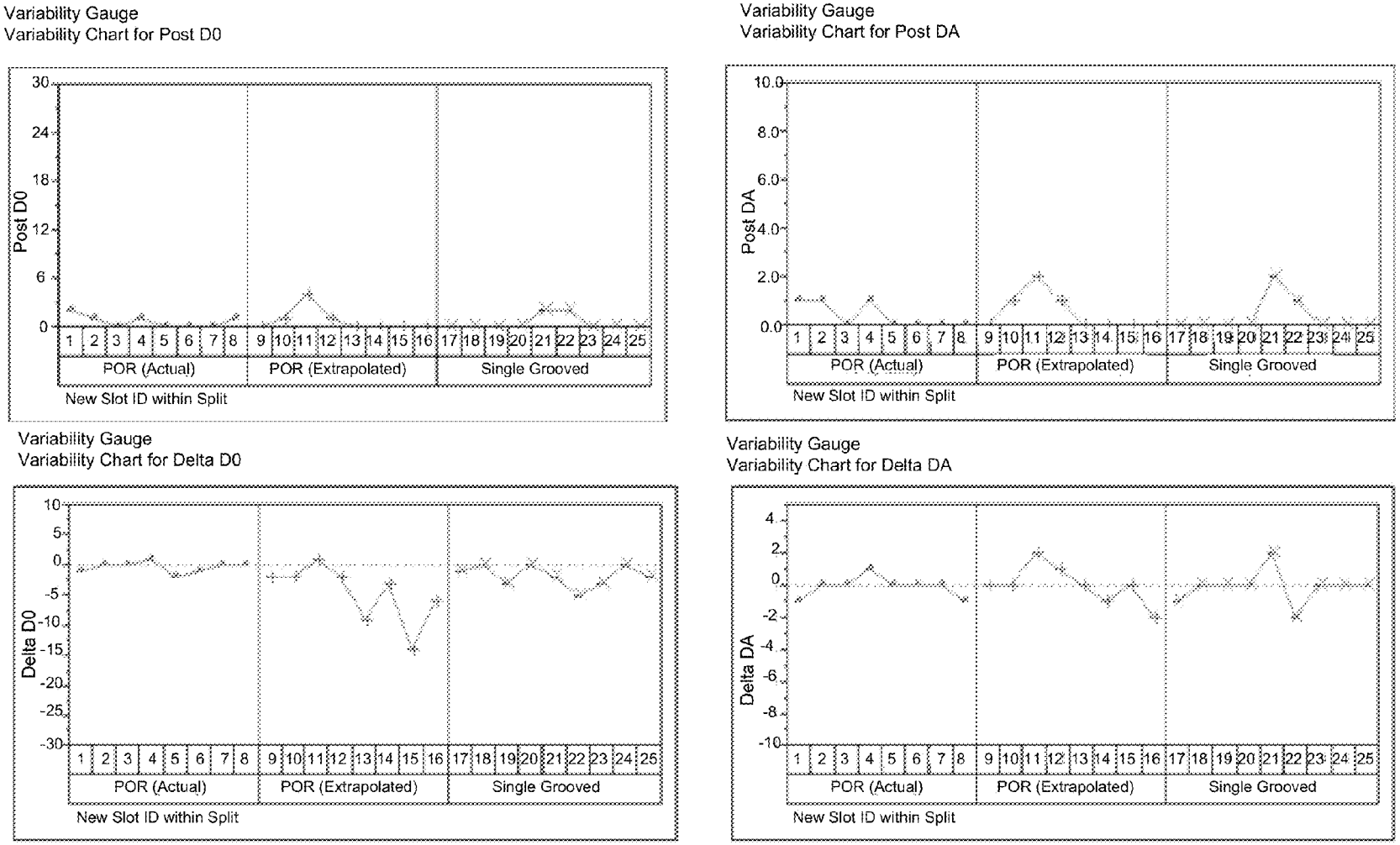

FIG. 4*e* shows a measurement of the particle performance of an extrapolated POR polishing pad as compared to a single grooved polishing pad. The measurement of the particle performance indicates how clean the wafer surface is after polishing. As can be seen, the single grooved polishing pad has comparable or better particle performance as compared with the extrapolated POR polishing pad.

Figure 4F:
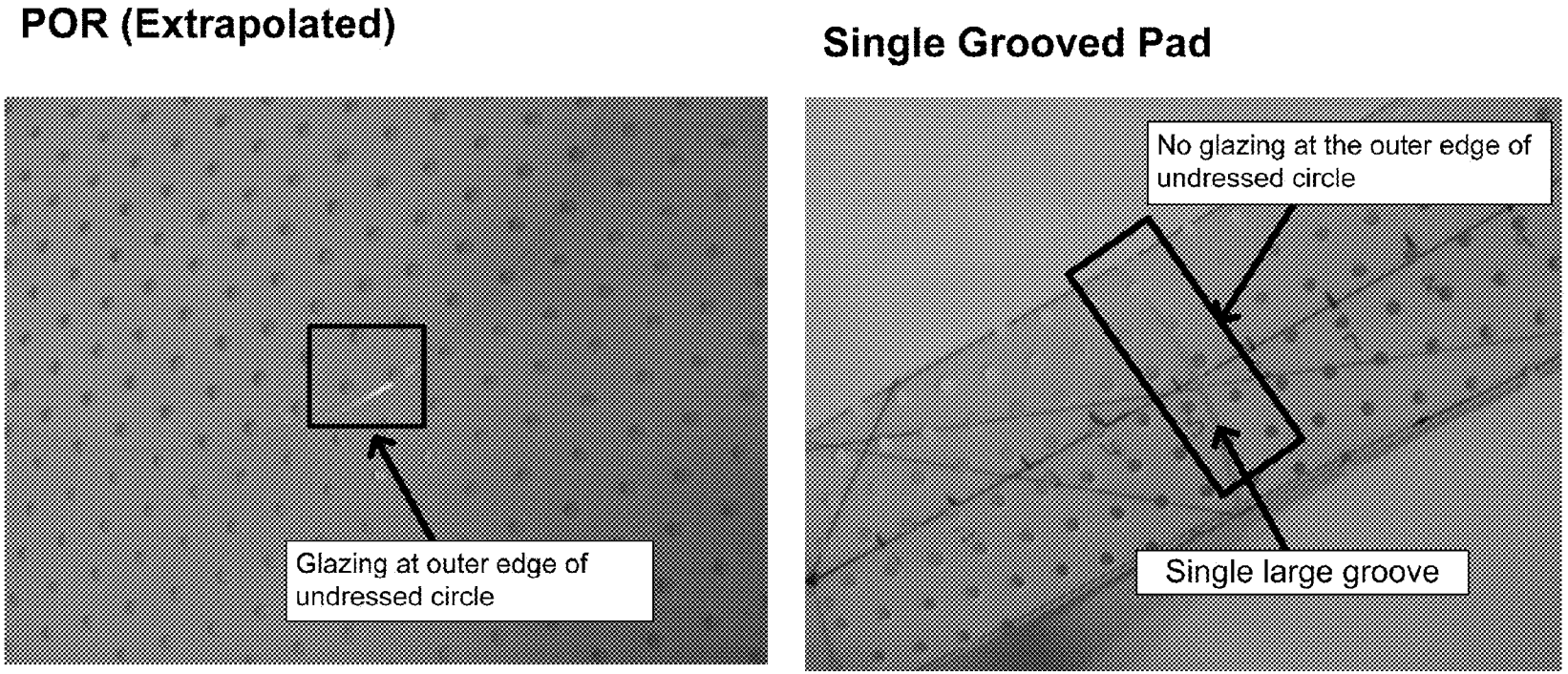

Finally, FIG. 4*f* shows the inspection result of an extrapolated POR polishing pad and the single grooved polishing pad after both pads have been used. As can be seen, the extrapolated POR polishing pad has a reflective mirror like sliver of pad glazing at the outer edge of an undressed portion, whereas the single grooved polishing pad shows no glazing at the outer edge of the undressed portion. While FIG. 4*f* shows a perforated polishing pad, in other embodiments, a non-perforated polishing may also be used.

To ensure consistency in the results, the above experiments were all done on test wafer from the same pod. The wafers are further randomized to minimize any possible Chemical Vapor Deposition influence. All the runs are done on the same table, with the same topring and dresser consumable set. The removal rate data is sampled when the pad life reaches designated life regions using manual dressing to approximate productions conditions. For both the extrapolated POR polishing pad and the single grooved polishing pad, 5 dummy wafers were run to season the polishing pads before 2 test wafers are used to sample the removal rate of the polishing pads.

As shown by the above discussion, the use of a single grooved polishing pad would result in improved removal rate stability, improved within wafer non-uniformity, as well as improved cut rate of the polishing pad. The pad profile has improved due to the fact that an acting dressing action downwards was not impeded by any undressed pad material. The particle performance of the single grooved polishing pad is also comparable to the extrapolated POR polishing pad. Use of the single grooved polishing pad also prevents the formation of glazing, which is characteristic of impeded dressing travel at the outer edge of the undress circle.

In yet other embodiments, the single grooved polishing pad may be used in a method for making a device. The method includes providing a wafer and polishing a first surface of the wafer with the single grooved polishing pad as described above. The method further includes dressing the single grooved polishing pad with a diamond dresser while the single grooved polishing pad is polishing the wafer; wherein the singular groove separating the dressed and undressed portion on the single grooved polishing pad is sufficiently wide to eliminate obstruction of the diamond dresser during dressing.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of the equivalency of the claims are intended to be embraced therein.

What is claimed is:

1. An apparatus for chemical mechanical polishing of semiconductor wafers comprising:

a first platform for mounting a semiconductor wafer;

a second platform for mounting a polishing pad with a polishing face and a centerline;

a rotator for rotating the wafer against the polishing pad;

a diamond dresser for performing a dressing operation on the polishing face of the polishing pad, the dressing operation configured to limit a distance from an outer edge of the diamond dresser to the centerline of the polishing pad to intentionally leave an undressed portion of the polishing face in a centermost area of the polishing pad after the dressing operation is complete; and wherein the polishing pad has only one groove on the polishing face, and when mounted onto the second platform, the polishing pad has a first portion and a second portion on the polishing face, the first portion corresponds to the undressed portion surrounded by the second portion which corresponds to a dressed portion, the second portion and first portion are separated by the only one groove, the one groove comprises;

a continuous inner groove edge without ends, the continuous inner groove edge is disposed adjacent to the undressed portion of the polishing face, the continuous inner groove surrounds the periphery of the undressed portion of the polishing pad and prevents contact of the diamond dresser with the polishing face radially inward of the continuous inner edge during the dressing operation, a continuous outer groove edge without ends, the continuous outer groove edge is disposed adjacent with an inner edge of the dressed portion of the polishing face, the continuous inner groove edge and continuous outer groove edge are distinct continuous groove edges, and a sealed bottom having a width (w), and wherein the w is sufficiently wide ensure that the diamond dresser dresses the dressed portion of the polishing face up to the continuous outer groove edge while preventing contact of the diamond dresser with the undressed portion of the polishing face within the continuous inner edge.

2. The apparatus of claim 1 wherein the one groove has a rectangular bottom.

3. The apparatus of claim 1 wherein the one groove has a polygonal bottom.

4. The apparatus of claim 1, wherein the one groove has a circular elliptical bottom.

5. The apparatus of claim 1, wherein the one groove has an inner circumference radius, an outer circumference radius, and a center circumference radius ($r_c$) that is spaced in equidistance apart from the inner circumference radius and outer circumference radius.

6. The apparatus of claim 5 wherein the center circumference radius ($r_c$) divided by the radius (R) of the polishing pad is a value between zero and 1.

7. The apparatus of claim 5 wherein the groove width (w) has a minimum dimension that is equal or larger than the region of the diamond dresser that is not covered by diamonds (D) and a maximum dimension that is smaller or equal to $r_c$+w/2.

8. The apparatus of claim 5 wherein the one groove has a depth (d), and the depth (d) divided by the thickness (T) of the polishing pad is a value between zero and 1.

9. The apparatus of claim 1 wherein the one groove and the undressed portion are merged and molded to form a depressed region that is below the surface of the polishing pad by a depth (d) to avoid physical contact with the diamond dresser.

10. A method for chemical mechanical polishing of semiconductor wafers comprising:

providing a semiconductor wafer with a first surface;

polishing the first surface of the wafer with a polishing pad, wherein the polishing pad comprises a polishing face having only one groove therein, a first portion corresponding to a dressed portion, and a second portion corresponding to an undressed portion, wherein the one groove separates the undressed portion from the dressed portion, the one groove comprises;

a continuous inner groove edge without ends, the continuous inner grove edge is disposed adjacent to the undressed portion of the polishing face, the continuous inner groove surrounds the periphery of the undressed portion of the polishing pad, a continuous outer groove edge without ends, the continuous outer groove edge is disposed adjacent with an inner edge of the dressed portion of the polishing face, the continuous inner groove edge and continuous outer groove edge are distinct continuous groove edges, and a sealed bottom having a width (w), wherein the only one groove separates the dressed portion from the undressed portion; and performing a dressing operation on the polishing pad with a diamond dresser, wherein the dressing operation contacts the dressed portion of the polishing face with the diamond dresser, wherein;

w is sufficiently wide ensure that the diamond dresser dresses the polishing face up to the continuous outer groove edge while preventing contact of the diamond dresser with the undressed portion of the polishing face within the continuous inner edge, and the dressing operation is performed in-situ while polishing the wafer or ex-situ without polishing the wafer.

11. The method of claim 10 wherein the only one groove which separates the dressed and undressed portions of the polishing pad improves pad profile of the polishing pad.

12. The method of claim 10 wherein the one groove has a rectangular bottom or a polygonal bottom.

13. The method of claim 10 wherein the one groove has a circular elliptical bottom.

14. The method of claim 10 wherein the one groove has an inner circumference radius, an outer circumference radius, and a center circumference radius ($r_c$) that is spaced in equidistance apart from the inner circumference radius and outer circumference radius.

15. The method of claim 14 wherein the center circumference radius ($r_c$) divided by the radius (R) of the polishing pad is a value between zero and 1.

16. The method of claim 14 wherein the one groove has a width (w) having a minimum dimension that is equal or larger than the region of the diamond dresser that is not covered by diamonds (D) and a maximum dimension that is smaller or equal to $r_c$+w/2.

17. The method of claim 14 wherein the one groove has a depth (d), and the depth (d) divided by the thickness (T) of the polishing pad is a value between zero and 1.

18. The method of claim 10 further comprising the step of merging and molding the one groove and the undressed portion to form a depressed region that is below the surface of the polishing pad by a depth (d) to avoid physical contact with the diamond dresser.

* * * * *